United States Patent [19]

Yu

[11] Patent Number: 5,021,309

[45] Date of Patent: Jun. 4, 1991

[54] MULTILAYERED PHOTORECEPTOR WITH ANTI-CURL CONTAINING PARTICULATE ORGANIC FILLER

[75] Inventor: Robert C. U. Yu, Webster, N.Y.

[73] Assignee: Xerox Corporation, Stamford, Conn.

[21] Appl. No.: 516,819

[22] Filed: Apr. 30, 1990

[51] Int. Cl.[5] ..... G03G 5/04; G03G 5/047

[52] U.S. Cl. ..... 430/58; 430/56; 430/531; 430/533; 430/930; 430/59

[58] Field of Search ..... 430/56, 531, 533, 58, 430/930

[56] References Cited

U.S. PATENT DOCUMENTS

| | | | |
|---|---|---|---|
| 3,121,006 | 2/1964 | Middleton et al. | 430/84 |
| 3,357,989 | 12/1967 | Byrne et al. | 430/78 |
| 3,442,781 | 5/1969 | Weinberger | 430/37 |
| 3,493,427 | 2/1970 | Takagi et al. | 430/56 X |
| 4,209,584 | 6/1980 | Joseph | 430/527 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,405,706 | 9/1983 | Takahashi et al. | 430/271 |
| 4,415,639 | 11/1983 | Horgan | 430/57 |
| 4,520,089 | 5/1985 | Tazuki et al. | 430/49 |
| 4,654,284 | 3/1987 | Yu et al. | 430/59 |
| 4,664,995 | 5/1987 | Horgan et al. | 430/59 |
| 4,942,104 | 7/1990 | Kitajima et al. | 430/930 X |
| 4,942,105 | 7/1990 | Yu | 430/930 X |
| 4,983,481 | 1/1991 | Yu | 430/930 X |

*Primary Examiner*—Roland Martin

*Attorney, Agent, or Firm*—Oliff & Berridge

[57] ABSTRACT

In an electrophotographic imaging device, material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

20 Claims, 1 Drawing Sheet

MULTILAYERED PHOTORECEPTOR WITH ANTI-CURL CONTAINING PARTICULATE ORGANIC FILLER

BACKGROUND OF THE INVENTION

This invention relates in general to electrophotography and, in particular, to an electrophotographic imaging member.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

When one or more photoconductive layers are applied to a flexible supporting substrate, it has been found that the resulting photoconductive member tends to curl. Coatings may be applied to the side of the supporting substrate opposite the photoconductive layer to counteract the tendency to curl. However, difficulties have been encountered with these anti-curl coatings.

For example, photoreceptor curl can sometimes still be encountered in as few as 1,500 imaging cycles under the stressful conditions of high temperature and high humidity. Further it has been found that during cycling of the photoconductive imaging member in electrophotographic imaging systems, the relatively rapid wear of the anti-curl coating also results in the curling of the photoconductive imaging member. In some tests, the anti-curl coating was completely removed in 150,000 to 200,000 cycles. This wear problem is even more pronounced when photoconductive imaging members in the form of webs or belts are supported in part by stationary guide surfaces which cause the anti-curl layer to wear away very rapidly and produce debris which scatters and deposits on critical machine components such as lenses, corona charging devices and the like, thereby adversely affecting machine performance. Also, the anti-curl coatings occasionally separate from the substrate during extended cycling and render the photoconductive imaging member unacceptable for forming quality images. It has also been found that when long webs of a flexible photoconductor having an anti-curl coating on one side of a supporting substrate and a photoconductive layer on the opposite side of the substrate are rolled into large rolls, the high surface contact friction of the anti-curl coating against the surface of the photoconductive imaging member causes dimples and creases to form on the photoconductive layer which result in print defects in the final developed images. Further, when the webs are formed into belts, the outer surface of the anti-curl belt experiences high surface contact friction with itself during shipment or storage at elevated temperatures which also causes creases and dimples to form which are seen as undesirable aberrations in the final printed images. Expensive and elaborate packaging is necessary to prevent the anti-curl coating from contacting itself. Further, difficulties have been encountered in continuous coating machines during the winter manufacturing of the coated photoconductive imaging members because of occasional seizing which prevents transport of the coated web through the machine for downstream processing.

Anti-curl layers will also occasionally delaminate due to poor adhesion to the supporting substrate. Moreover, in electrostatographic imaging systems, where transparency of the substrate and anti-curl layer is necessary for rear exposure to activating electromagnetic radiation, any exposure to activating electromagnetic radiation or any reduction of transparency due to opacity of the supporting substrate or anti-curl layer will cause a reduction in performance of the photoconductive imaging member. Although the reduction in transparency may in some cases be compensated for by increasing the intensity of the electromagnetic radiation, such increase is generally undesirable due to the amount of heat generated, as well as the greater cost to achieve higher intensity. An anti-curl layer which exhibits the above deficiencies is highly undesirable.

U.S. Pat. No. 4,654,284 to Yu et al discloses an anti-curl layer comprising a reaction product of a binder bifunctional coupling agent and crystalline particles such as silica. Although these inorganic particles provide wear resistance and reduced surface contact friction, they have exhibited one shortcoming of causing a sonic horn to wear when ultrasonically lap-joining the photoconductive imaging members into belts.

U.S. Pat. No. 4,209,584 to Joseph discloses photographic elements having anti-curl and anti-static layers. The anti-curl layer comprises a hydrophillic colloid which is hardened by a hardening agent. The anti-curl layer is not subject to wear since it is overcoated with the anti-static layer.

U.S. Pat. No. 4,520,089 to Tazuki et al discloses electrophotographic offset masters which are provided with a back coat layer. The back coat layer contains an inorganic pigment component such as sericite.

There continues to be a need to increase the durability and extend the life of the exposed anti-curl layer in an imaging device as well as to reduce frictional contact between members of the imaging device while maintaining electrical and mechanical integrity.

SUMMARY OF THE INVENTION

It is an object of the invention to reduce wear and increase durability of an exposed anti-curl layer in a photosensitive device.

It is also an object of the invention to reduce frictional contact between contacting members in an imaging device.

It is another object of the invention to provide an electrophotographic imaging member having improved wear resistance of the exposed anti-curl layer, and to maintain the optical and mechanical integrity of the layer.

It is still another object of the invention to provide an electrophotographic imaging member that is free of dimples and creases.

It is a further object of the present invention to provide an improved electrophotographic imaging member having an anti-curl layer which provides good adhesion to a supporting substrate and exhibits greater resistance to layer delamination.

It is still a further object of the present invention to provide organic fillers for increasing wear resistance.

It is still yet another object of the present invention to provide an electrophotographic imaging member having an anti-curl layer comprising particulate fillers which do not cause the ultra-sonic horn to wear during belt seaming processes.

The present invention overcomes the shortcomings of the prior art by providing an anti-curl layer in an imaging member comprising organic fillers. Organic fillers are incorporated in the exposed anti-curl layer of an electrophotographic imaging member. The organic fillers employed to achieve this purpose are organic particles such as fluorocarbon polymers, polyethylene waxes, fatty amides, and various stearates.

BRIEF DESCRIPTION OF THE DRAWINGS

A more complete understanding of the present invention can be obtained by reference to FIG. 1, which is a cross-sectional view of a multilayer photoreceptor of the invention.

DESCRIPTION OF PREFERRED EMBODIMENTS

Figure 1:
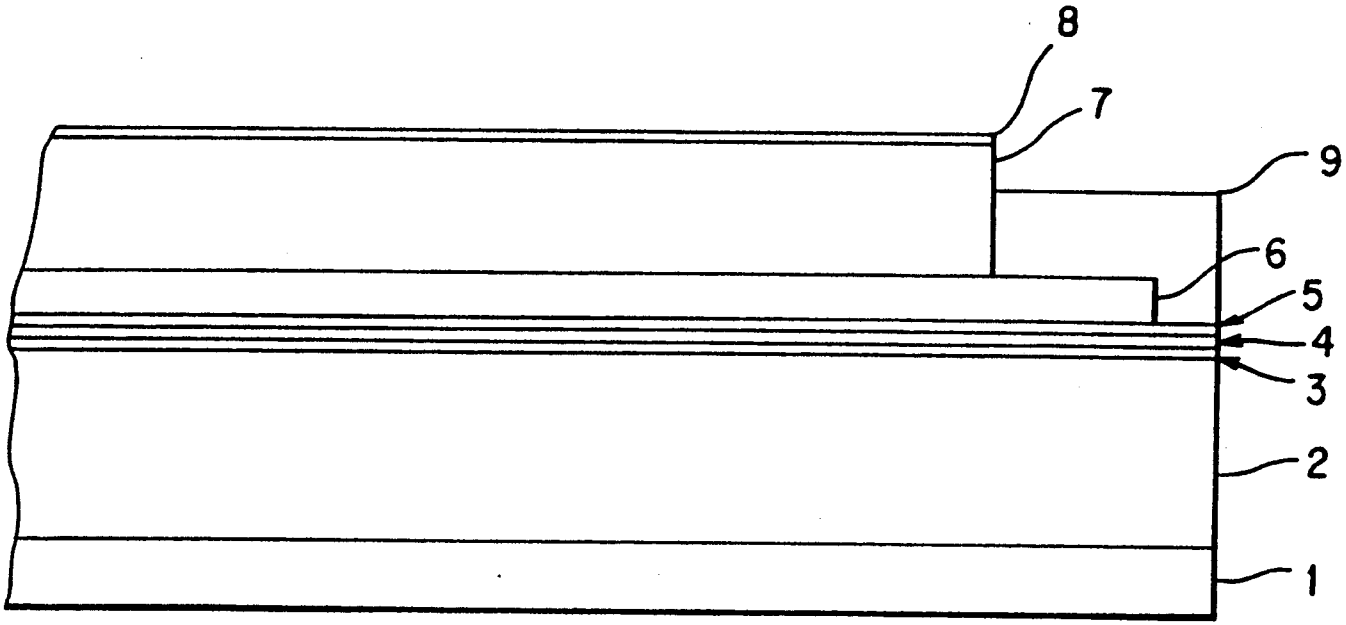

The electrophotographic imaging member according to the present invention contains an anti-curl layer which includes dispersed organic fillers, preferably in a homogeneous dispersion. The homogeneous dispersion of fillers of the present invention in film-forming polymer binder provides an anti-curl layer of reduced coefficient of surface friction without adverse effects on optical and mechanical properties.

A representative structure of an electrophotographic imaging member is shown in FIG. 1. This imaging member is provided with an anti-curl layer 1, a supporting substrate 2, an electrically conductive ground plane 3, a hole blocking layer 4, an adhesive layer 5, a charge-generating layer 6, and a charge transport layer 7. An optional overcoating layer 8 is also shown in FIG. 1.

In the above-described device, a ground strip 9 may be provided adjacent the charge transport layer at an outer edge of the imaging member. See U.S. Pat. No. 4,664,995. The ground strip 9 is coextruded with the charge transport layer so as to provide grounding contact with a grounding device (not shown) during electrophotographic processes.

A description of the layers of the electrophotographic imaging member shown in FIG. 1 follows.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex, available from ICI Americas Inc., or Hostaphan, available from American Hoechst Corporation.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Blocking Layer

After deposition of the electrically conductive ground plane layer, the blocking layer 4 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen-containing siloxanes or nitrogen-containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

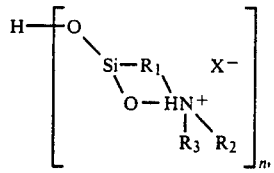

I or

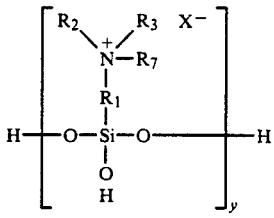

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

The Adhesive Layer

In most cases, intermediate layers between the blocking layer and the adjacent charge-generating or photogenerating layer may be desired to promote adhesion. For example, the adhesive layer 5 may be employed. If such layers are utilized, they preferably have a dry thickness between about 0.001 micrometer to about 0.2 micrometer. Typical adhesive layers include film-forming polymers such as polyester, du Pont 49,000 resin (available from E.I. du Pont de Nemours & Co.), Vitel-PE100 (available from Goodyear Rubber & Tire Co.), polyvinylbutyral, polyvinylpyrrolidone, polyurethane, polymethyl methacrylate, and the like.

The Charge-Generating Layer

Any suitable charge-generating (photogenerating) layer 6 may be applied to the adhesive layer 5. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal-free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 (trade names for dibromo anthanthrone pigments), benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge-generating layers comprising a photoconductive material such as vanadyl phthalocyanine, metalfree phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infra-red light.

Any suitable polymeric film-forming binder material may be employed as the matrix in the photogenerating layer. Typical polymeric film-forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge-generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge-generating layer binder polymer should dissolve the polymer binder utilized in the charge-generating layer and be capable of dispersing the photogenerating pigment particles present in the charge-generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected, providing the objectives of the present invention are achieved.

Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The Charge Transport Layer

The charge transport layer 7 may comprise any suitable transparent organic polymer or non-polymeric material capable of supporting the injection of photogenerated holes or electrons from the charge generating layer 6 and allowing the transport of these holes or electrons through the organic layer to selectively discharge the surface charge. The charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is normally transparent in a wavelength region in which the photoconductor is to be used when exposure is effected therethrough to ensure that most of the incident radiation is utilized by the underlying charge-generating layer. When used with a transparent substrate, imagewise exposure or erasure may be accomplished through the substrate with all light passing through the substrate. In this case, the charge transport material need not transmit light in the wavelength region of use. The charge transport layer in conjunction with the charge-generating layer is a insulator to the extent that an electrostatic charge placed on the charge transport layer is not conducted in the absence of illumination.

The charge transport layer may comprise activating compounds or charge transport molecules dispersed in normally electrically inactive film-forming polymeric materials for making these materials electrically active.

These charge transport molecules may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge-transporting aromatic amine, and about 75 percent to about 25 percent by weight of a polymeric film-forming resin in which the aromatic amine is soluble.

The charge transport layer is preferably formed from a mixture comprising at least one aromatic amine compound of the formula:

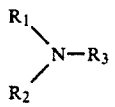

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

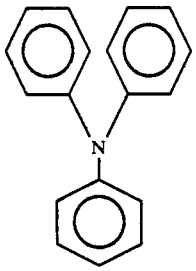

II. Bis and poly triarylamines such as:

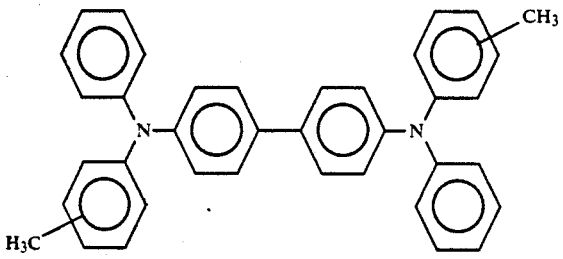

III. Bis arylamine ethers such as:

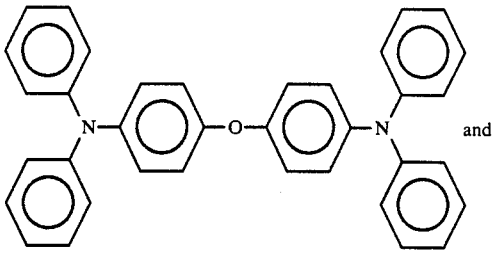

and

IV. Bis alkyl-arylamines such as:

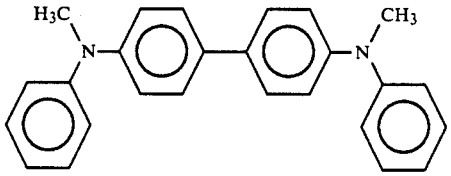

A preferred aromatic amine compound has the general formula:

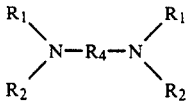

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4'-4''-bis(diethylamino)-2',2''-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N''-bis(3''-methylphenyl)-(1,1'biphenyl)-4,4'-diamine; and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company;

a polycarbonate resin having a molecular weight of from about 50,000 to about 100,000, available as Makrolon from Farbenfabricken Bayer A.G.; a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayer photoconductor comprises a charge-generating layer comprising a binder layer of photoconductive material and a contiguous hole transport layer of a polycarbonate resin material having a molecular weight of from about 20,000 to about 120,000, having dispersed therein from about 25 to about 75 percent by weight of one or more compounds having the formula:

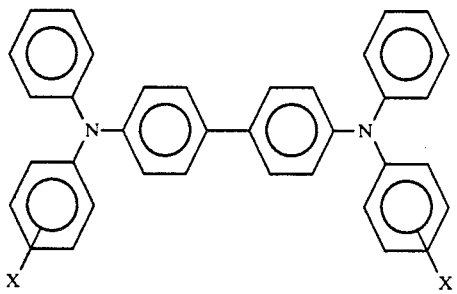

wherein X is selected from the group consisting of an alkyl group, having from 1 to about 4 carbon atoms, and chlorine, the photoconductive layer exhibiting the capability of photogeneration of holes and injection of the holes, the hole transport layer being substantially nonabsorbing in the spectral region at which the photoconductive layer generates and injects photogenerated holes but being capable of supporting the injection of photogenerated holes from the photoconductive layer and transporting the holes through the hole transport layer.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip may comprise a film-forming polymer binder and electrically conductive particles. Cellulose may be used to disperse the conductive particles. Any suitable electrically conductive particles may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Overcoating Layer

The optional overcoating layer 8 may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

The Anti-Curl Layer

The anti-curl layer 1 may comprise organic polymers or inorganic polymers in addition to the organic fillers of the invention. Since the conductive imaging member curls into a member having up to about 0.75 inch radius of curvature after application of all the imaging layers, the anti-curl layer coated at the backside of the supporting substrate 2 opposite to the imaging layers provides flatness and/or abrasion resistance to the resulting imaging member.

The anti-curl layer may comprise a film-forming resin and an adhesion promoter polyester additive. Examples of film-forming resins include polyacrylate, polystyrene, poly(4,4'-isopropylidene diphenyl carbonate), 4,4'-cyclohexylidene diphenyl polycarbonate, and the like. Typical adhesion promoters used as additives include copolyesters, for example, du Pont 49,000 (du Pont), Vitel PE-100, Vitel PE-200, Vitel PE-307 (Goodyear), and the like. Usually from about 1 to about 15 weight percent adhesion promoter is selected for film-forming resin addition. From about 0.1 weight percent to about 7 weight percent of PE100 may be used, preferably from about 0.1 weight percent to about 3 weight percent, and more preferably, from about 0.5 weight percent to about 1.5 weight percent. With PE-200, PE-307 and du Pont 49,000, from 1 weight percent to about 30 weight percent may be used, preferably about 1 weight percent to about 20 weight percent, and more preferably about 2 weight percent to about 10 weight percent.

du Pont 49,000 is a linear saturated copolyester of four diacids and ethylene glycol having a molecular weight of about 70,000. Its molecular structure is represented as $$HO-\overset{\overset{\displaystyle O}{\|}}{C}-[\text{Diacid-Ethylene glycol}]_n-OH$$

The ratio of diacid to ethylene glycol in the copolyester is 1:1. The diacids are terephthalic acid, isophthalic acid, adipic acid and azelaic acid in a ratio of 4:4:1:1.

Vitel PE-100 is a linear copolyester of two diacids and ethylene glycol having a molecular weight of about 50,000. Its molecular structure is represented as $$HO-\overset{O}{\overset{\|}{C}}-[\text{Diacid-Ethylene glycol}]_n-OH$$

The ratio of diacid to ethylene glycol in the copolyester is 1:1. The two diacids are terephthalic acid and isophthalic acid in a ratio of 3:2.

Vitel PE-200 is a linear saturated copolyester of two diacids and two diols having a molecular weight of about 45,000. The molecular structure is represented as $$HO-\overset{O}{\overset{\|}{C}}-[\text{Diacid-Diol}]_n-OH$$

The ratio of diacid to diol in the copolyester is 1:1. The two diacids are terephthalic and isophthalic acid in a ratio of 1.2:1. The two diols are ethylene glycol and 2,2-dimethyl propane diol in a ratio of 1.33:1.

The thickness of the anti-curl layer depends on the degree of photoconductive imaging member curling caused by the charge transport layer. The thickness is from about 3 micrometers to about 35 micrometers, and preferably about 14 micrometers.

The fillers chosen for the present invention are organic fillers. These fillers are selected for suitable dispersion in the anti-curl layer. The fillers are preferably easily dispersed by conventional coating solution mixing techniques and result in no particle agglomerations in the dry anti-curl layer. The fillers further have inherent wear-resisting characteristics and are capable of providing lubricity to ease the sliding mechanical interaction at the anti-curl layer surface. The fillers preferably have refractive indices closely matched with that of the binder polymer so that particle dispersions in the polymer matrix do not affect the optical transmittancy of the layer.

The organic fillers selected for anti-curl layer dispersion include fluorocarbon polymers, fatty amides, polyethylene waxes, polypropylene waxes and stearates, and mixtures thereof. In particular, these organic fillers include, for example, POLYMIST and ALGOFLON from Ausimont U.S.A., Inc. Petrac Erucamide, Petrac Oleamide, and Petrac Stearamide from Synthetic Products Company, ACUMIST from Allied-Signal, Inc., and metal stearates from Synthetic Products Company.

POLYMIST, available from Allied Chemical, Inc., comprises irregularly shaped polytetrafluoroethylene (PTFE) particles that are gamma ray irradiated to increase their hardness. As a result of gamma ray irradiation, the POLYMIST exhibits improved wear properties when incorporated into the anti-curl layer. Of course, other fluorocarbon polymers such as ALGOFLON (irregular shaped PTFE particles) may be used.

Petrac Erucamide, Petrac Oleamide, and Petrac Stearamide, available from Synthetic Products Company, are irregular shape particulates of high molecular weight fatty amides which are reaction products between ammonia and fatty acids, such as Erucic acid, oleic acid and stearic acid. When present in the anti-curl layer, they lower the surface contact friction and improve wear resistance.

ACUMIST, available from Allied-Signal, Inc., comprises irregularly shaped micronized waxy polyethylene particles having the molecular formula $CH_3(CH_2)_mCH_3$, in which m is a number of repeating units for a molecular weight between about 2000 and about 3500. The oxidized form of ACUMIST is a polyethylene homopolymer having a molecular formula $CH_3(CH_2)_mCH_2COOH$.

Metal stearates such as zinc and tin stearates from Synthetic Products Company are used in the present invention to improve wear and frictional properties of the anti-curl layer. Other stearates include, for example, stannous stearates, calcium stearates, and magnesium stearates.

The above organic fillers, as supplied by the manufacturers, have particle size distributions from about 0.1 micrometer to about 10 micrometers in diameter. For anti-curl layer dispersion, these fillers are classified (except for fillers such as Petrac Erucamide and Petrac Oleamide which are soluble in the solvent used in the anti-curl coating solution) to give a preferred particle diameter range between about 0.1 micrometer and about 4.5 micrometers, with an average particle diameter of about 2.5 micrometers.

Other commercially available organic fillers included in the present invention are Fluorocarbon Micropowder (submicron size PTFE) available from DuPont Company, Polyethylene Wax available from Petrolite Corporation, Calcium Stearate and Magnesium Stearate available from Synthetic Products Company, Acrawax (N,N'-ethylene bisstearamide) available from Lonza Inc., and Polysilk polyethylene wax/PTFE blend) and Micropro (polypropylene wax) available from Micro Powders, Inc. To eliminate the large particle size to suit the present invention purpose, these commercial organic fillers are classified to give a particle size distribution ranging from about 0.1 micrometer to about 4.5 micrometers and having an average particle diameter of approximately 2.5 micrometers. These organic particulates should be incorporated into an anti-curl layer to achieve the desired purpose of improving the wear property as well as the frictional characteristic of the resulting anti-curl layer.

In the above anti-curl layer, the filler materials of the present invention may be incorporated directly into the solutions used to prepare the layer. The anti-curl layer may be filled with these materials to reduce the coefficient of friction, increase wear properties, and improve its adhesion strength to the supporting substrate without adversely affecting the optical mechanical functions of the resulting anti-curl layer.

The coating solutions of the invention can be applied by any of a number of known photoreceptor fabricating techniques. Typical coating techniques include solvent coating, extrusion coating, spray coating, dip coating, lamination, solution spin coating and the like. Further, the coating solutions can be used with seamless organic photoreceptor belt processes. The coated solutions may be dried by conventional drying techniques such as oven drying, forced air drying, circulating air oven drying, radiant heat drying, and the like.

The fillers of the invention can be present in the anti-curl layer of the imaging member in a range of about 0.5 percent by weight to about 20 percent by weight, preferably less than about 10 percent by weight, based on the weight of solids in the anti-curl layer. It has been noted that a filler loading exceeding about 20 percent by weight causes the optical transmission (clarity) to fall off, while a loading less than about 5 percent by weight only slightly improves wear resistance.

The invention will further be illustrated in the following non-limitative examples, it being understood that these examples are intended to be illustrative only and that the invention is not intended to be limited to the materials, conditions, process parameters and the like recited herein.

COMPARATIVE EXAMPLE I

A photoconductive imaging member is prepared by providing a web of titanium coated polyester (Melinex 442 available from ICI Americas Inc.) substrate having a thickness of 3 mils, and applying thereto, using a gravure applicator, a solution containing 50 grams 3-amino-propyltriethoxysilane, 15 grams acetic acid, 684.8 grams of 200 proof denatured alcohol and 200 grams heptane. This layer is then dried for 10 minutes at 135° C. in a forced air oven. The resulting blocking layer has a dry thickness of 0.05 micrometer.

An adhesive interface layer is then prepared by applying a wet coating over the blocking layer, using a gravure applicator, containing 0.5 percent by weight based on the total weight of the solution of polyester adhesive (DuPont 49,000, available from E.I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N'-diphenyl-N,N'-bis(3-methyl- phenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is then placed on a shaker for 10 minutes. The resulting slurry is thereafter applied to the adhesive interface with an extrusion die to form a layer having a wet thickness of about 0.5 mil. This photogenerating layer is dried at 135° C. for 5 minutes in a forced air oven to form a photogenerating layer having a dry thickness of 2.3 micrometers.

This member is then coated over with a charge transport layer. The charge transport coating solution is prepared by introducing into a carboy container in a weight ratio of 1:1 N,N'-diphenyl-N,N,-bis(3-methylphenyl)-1,1'-biphenyl-4,4'-diamine, and the binder resin Makrolon 5705, a polycarbonate having a weight average molecular weight from about 50,000 to about 1,000,000, available from Farbenfabricken Bayer AG. The resulting solid mixture is dissolved in methylene chloride to provide a 15 weight percent solution thereof. This solution is then applied onto the photogenerator layer by extrusion coating to form a wet charge transport layer. The resulting photoconductive member is then dried at 135° C. in a forced air oven for 5 minutes to produce a 24 micrometers dry thickness charge transport layer.

After the machine coating described above, a 9 inches x 12 inches piece sample of the resulting photoreceptor device containing all the imaging layers is cut from the web for anti-curl layer application by hand coating. The anti-curl coating solution is prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride. The glass bottle is then covered tightly and placed on a roll mill for about 24 hours until total dissolution of the polycarbonate and the copolyester is achieved. The anti-curl coating solution thus obtained is applied to the rear surface of the supporting substrate (the side opposite to the imaging layers) of the photoreceptor device by hand coating using a 3 mil gap Bird applicator. The coated wet film is dried at 135° C. in an air circulation oven for about 5 minutes to produce a dry, 14 micrometers thick anti-curl layer.

EXAMPLE II

A photoconductive imaging member having two electrically operative layers as described in Comparative Example I is fabricated using the same procedures and materials, except that an anti-curl layer of the present invention is used to replace the anti-curl layer of Example I. The invention anti-curl layer solution is prepared by dissolving 86.43 grams Makrolon and 0.88 gram Vitel PE-100 in 900.7 grams methylene chloride. To the solution is added 1.78 grams ALGOFLON (PTFE), available from Ausimont U.S.A. Inc., to form 989.79 grams of mixture. With the aid of a high shear blade disperser (Tekmar Dispax Dispersator), the ALGOFLON particles are dispersed in the solution inside a water cooled, jacketed container to prevent the solution from overheating and losing solvent due to evaporation. ALGOFLON comprises irregular shape particles of PTFE and is classified to give a particle size range from about 0.1 micrometer to about 4.5 micrometers in diameter. The average particle diameter is about 2.5 micrometers.

The resulting dispersion is then applied to the backside of the supporting substrate of the photoreceptor by hand coating using a 5 mil gap Bird applicator. The fabricated photoreceptor device having the wet coating is dried at 135° C. for 5 minutes in a forced air oven. The dry thickness of the anti-curl layer is 14 micrometers and contains 2 weight percent of ALGOFLON.

EXAMPLE III

A photoconductive imaging member having two electrically operative layers as described in Example II is fabricated by following the same procedures and using the same materials, except that the 14 micrometers dry thickness anti-curl layer contains 5 weight percent ALGOFLON.

EXAMPLE IV

A photoconductive imaging member having two electrically operative layers as described in Example II is fabricated using the same procedures and materials, except that the 14 micrometers dry thickness anti-curl layer contains 10 weight percent ALGOFLON.

EXAMPLE V

A photoconductive imaging member having two electrically operative layers as described in Example II is fabricated using the same procedures and materials, except that the filler content in the 14 micrometers dry thickness anti-curl layer is 15 weight percent ALGOFLON.

EXAMPLE VI

A photoconductive imaging member having two electrically operative layers is fabricated using the same procedures and materials as described in Example II with the exception that the ALGOFLON particles are replaced by classified particulates of POLYMIST (gamma ray irradiated PTFE, available from Ausimont U.S.A., Inc.) for the invention anti-curl layer coating. The dry thickness of the resulting anti-curl layer is 14 micrometers and contains 2 weight percent POLYMIST.

EXAMPLE VII

A photoconductive imaging member having two electrically operative layers is fabricated using the same procedures and materials as described in Example VI, except that the 14 micrometers dry thickness anti-curl layer contains 5 weight percent POLYMIST.

EXAMPLE VIII

A photoconductive imaging member having two electrically operative layers is fabricated using the same procedures and materials as described in Example VI, except that the POLYMIST loading in the 14 micrometers dry thickness anti-curl layer is 10 weight percent.

EXAMPLE IX

A photoconductive imaging member having two electrically operative layers is fabricated using the procedures and materials as described in Example VI, except that the particulate content in the 14 micrometers dry thickness anti-curl layer is 15 weight percent.

EXAMPLE X

A photoconductive imaging member having two electrically operative layers is fabricated using the same procedures and materials as described in EXAMPLE II, with the exception that the ALGOFLON particles are replaced by Petrac Oleamide (available from Synthetic Products Company) for the invention anti-curl layer formulation. Petrac Oleamide is irregular shape particulates of fatty amide of the molecular formula $$CH_2(CH_2)_7CH{=}CH(CH_2)_7\overset{\overset{O}{\|}}{C}NH_2$$

produced through chemical reaction between ammonia and oleic acid. Being an unsaturated fatty amide, the Petrac Oleamide is readily soluble in methylene chloride.

The invention anti-curl layer solution is prepared by dissolving 86.43 grams Makrolon, 0.88 gram Vitel PE-100 and 1.78 grams of Petrac Oleamide in 900.7 grams methylene chloride. The resulting anti-curl coating solution is then applied to the back side of the supporting PET substrate of the photoreceptor by hand coating using a 5 mil gap Bird applicator. The fabricated photoreceptor device having the wet coating is dried at 135° C. for 5 minutes in a forced air oven. The dry thickness of the anti-curl layer is 14 micrometers and contains 2 weight percent of homogeneously dispersed phase separated Oleamide spheres of about 1 micrometer in diameter.

EXAMPLE XI

A photoconductive imaging member is fabricated using the same materials and procedures as described in Example X, except that the 14 micrometers dry thickness anti-curl layer contains 5 weight percent Oleamide spheres.

EXAMPLE XII

A photoconductive imaging member is fabricated by following the same procedures and using the same materials as described in Example X, except that the 14 micrometers dry thickness anti-curl layer contains 10 weight percent Oleamide spheres.

EXAMPLE XIII

A photoconductive imaging member is fabricated using the same procedures and materials as described in Example X, except that 15 weight percent of the Oleamide spheres are contained in the 14 micrometers dry thickness anti-curl layer.

EXAMPLE XIV

A photoconductive imaging member having two electrically operative layers is fabricated by following the same procedures and using the same materials as described in Example X, with the exception that the Petrac Oleamide is replaced by Petrac Erucamide (available from Synthetic Products Company) for the invention anti-curl layer formulation. Petrac Erucamide is irregular shape particulates of high molecular weight fatty amide of the molecular formula $$CH_3(CH_2)_7CH{=}CH(CH_2)_{11}\overset{\overset{O}{\|}}{C}NH_2$$

a reaction product between ammonia and Erucic acid. Being an unsaturated fatty amide, the Petrac Erucamide is readily soluble in methylene chloride.

The invention anti-curl layer solution is prepared by dissolving 86.43 grams Makrolon, 0.88 gram Vitel PE-100, and 1.78 grams Petrac Erucamide in 900.7 grams methylene chloride. The resulting anti-curl coating solution is then applied to the back side of the supporting PET substrate of the photoreceptor by hand coating using a 5 mil Bird applicator. The fabricated photoreceptor device having the wet coating is dried at 135° C. for 5 minutes in a forced air oven. The dry thickness of the anti-curl layer is 14 micrometers and contains 2 weight percent of homogeneously dispersed phase separated Erucamide spheres having a diameter of about 1 micrometer.

EXAMPLE XV

A photoconductive imaging member is fabricated in the same manner and using the same materials as described in Example XIV, except that the 14 micrometers dry thickness anti-curl layer contains 5 weight percent Erucamide spheres.

EXAMPLE XVI

A photoconductive imaging member is fabricated in the same manner and using the same materials as described in Example XIV, except that the 14 micrometers dry thickness anti-curl layer contains 10 weight percent Erucamide spheres.

EXAMPLE XVII

A photoconductive imaging member is fabricated in the same manner and using the same materials as described in Example XIV, except that the Erucamide spheres in the 14 micrometers dry thickness anti-curl layer is 15 weight percent.

EXAMPLE XVIII

A photoconductive imaging member having two electrically operative layers is fabricated by using the same procedures and materials as described in Example X, with the exception that the Petrac Oleamide is replaced by Petrac Stearamide (available from Synthetic Products Company) for the invention anti-curl layer formulation. Petrac Stearamide is irregular shape particulates of fatty amide of the molecular formula $$CH_3(CH_2)_{16}\overset{\overset{\displaystyle O}{\|}}{C}NH_2$$

obtained by chemical reaction between ammonia and Stearic acid. Being a saturated fatty amide, the Petrac Stearamide has very limited solubility in methylene chloride. The particles are classified to give a particle size between about 0.1 micrometer and about 4.5 micrometers with an average particle diameter of about 2.5 micrometers.

The invention anti-curl layer solution is prepared by dissolving 86.43 grams Makrolon and 0.88 grams Vitel PE-100 in 900.7 grams methylene chloride. To the solution is added 1.78 grams Petrac Stearamide to form 989.79 grams of mixture. With the aid of a high shear blade disperser (Tekmar Dispax Dispersator), the Petrac Stearamide particles are dispersed in the solution inside a water cooled, jacketed container to prevent the solution from overheating and solvent being lost due to evaporation. The resulting dispersion is then applied to the back side of the PET supporting substrate of the photoreceptor by hand coating using a 5 mil gap Bird applicator. The fabricated photoreceptor device having the wet coating is dried at 135° C. for 5 minutes in a forced air oven. The dry thickness of the anti-curl layer is 14 micrometers and contains 2 weight percent Petrac Stearamide.

EXAMPLE XIX

A photoconductive imaging member is fabricated using the same procedures and materials described in Example XVIII, except that the 14 micrometers dry thickness anti-curl layer contains 5 weight percent Petrac Stearamide.

EXAMPLE XX

A photoconductive imaging member is fabricated using the same procedures and materials as described in Example XVIII, except that the 14 micrometers dry thickness anti-curl layer consists of 10 weight percent Petrac Stearamide.

EXAMPLE XXI

A photoconductive imaging member is fabricated using the same procedures and materials as described in Example XVIII, except that the 14 micrometers dry thickness anti-curl layer is filled with 15 weight percent Petrac Stearamide.

EXAMPLE XXII

A photoconductive imaging member having two electrically operative layers is fabricated by using the same procedures and materials as described in Example II, with the exception that the ALGOFLON is replaced by Synpro Zinc Stearate (available from Synthetic Products Company) for the invention anti-curl layer formulation. Synpro Zinc Stearate is irregular shape particulates of a reaction product obtained from a saponification process between an inorganic base and stearic acid. For present invention application, the Synpro Zinc Stearate is classified to give a particle size distribution ranging between about 0.1 micrometer and about 4.5 micrometers, the average particle size of which is about 2.5 micrometers in diameter.

The invention anti-curl layer solution is prepared by dissolving 86.43 grams Makrolon and 0.88 grams Vitel PE-100 in 900.7 grams methylene chloride. To the solution is added 1.78 grams Synpro Zinc stearate to form 989.79 grams of mixture. With the aid of a high shear blade disperser (Tekmar Dispax Dispersator), the Synpro Zinc Stearate particles are dispersed in the solution inside a water cooled, jacketed container to prevent the solution from overheating and solvent being lost due to evaporation. The resulting dispersion is then applied to the back side of the PET supporting substrate of the photoreceptor by hand coating using a 5 mil gap Bird applicator. The fabricated photoreceptor device having the wet coating is dried at 135° C. for 5 minutes in a forced air oven. The dry thickness of the anti-curl layer is 14 micrometers and contains 2 weight percent Synpro Zinc Stearate.

EXAMPLE XXIII

A photoconductive imaging member is fabricated using the same procedures and materials as described in Example XXII, except that the 14 micrometers dry thickness anti-curl layer contains 5 weight percent Synpro Zinc Stearate.

EXAMPLE XXIV

A photoconductive imaging member is fabricated using the same procedures and materials as described in Example XXII, except that the 14 micrometers dry thickness anti-curl layer contains 10 weight percent Synpro Zinc Stearate.

EXAMPLE XXV

A photoconductive imaging member is fabricated using the same procedures and materials as described in Example XXII, except that the 14 micrometers dry thickness anti-curl layer is loaded with 15 weight percent Synpro Zinc Stearate.

EXAMPLE XXVI

A photoconductive imaging member having two electrically operative layers is fabricated by using the same procedures and materials as described in Example II, with the exception that the ALGOFLON is replaced by Synpro Stannous Stearate (available from Synthetic Products Company) for the invention anti-curl layer formulation. The Synpro Stannous Stearate is irregular shape particulates of a reaction product obtained from a saponification process between an inorganic base and stearic acid. The Synpro Stannous Stearate is classified to give a particle size distribution ranging from about 0.1 micrometer to about 4.5 micrometers, the average particle size of which is approximately 2.5 micrometers in diameter.

The invention anti-curl layer solution is prepared by dissolving 86.43 grams Makrolon and 0.88 grams Vitel PE-100 in 900.7 grams methylene chloride. To the solution is added 1.78 grams of Synpro Stannous Stearate to give 989.79 grams of mixture. With the aid of a high shear blade disperser (Tekmar Dispax Dispersator), the Synpro Stannous Stearate particles are dispersed in the solution inside a water cooled, jacketed container to prevent the solution from overheating and solvent being lost due to evaporation. The resulting dispersion is then applied to the back side of the PET supporting substrate of the photoreceptor by hand coating using a 5 mil gap Bird applicator. The fabricated photoreceptor device having the wet coating is dried at 135° C. for 5 minutes in a forced air oven. The dry thickness of the anti-curl layer is 14 micrometers and contains 2 weight percent Synpro Stannous Stearate.

EXAMPLE XXVII

A photoconductive imaging member is fabricated in the same fashion as described in Example XXVI, except that the 14 micrometers dry thickness anti-curl layer contains 5 weight percent Synpro Stannous Stearate.

EXAMPLE XXVIII

A photoconductive imaging member is fabricated in the same fashion as described in Example XXVI, except that the 14 micrometers dry thickness anti-curl layer consists of 10 weight percent Synpro Stannous Stearate.

EXAMPLE XXIX

A photoconductive imaging member is fabricated in the same fashion as described in Example XXVI, except that the 14 micrometers dry thickness anti-curl layer is filled with 15 weight percent Synpro Stannous Stearate.

EXAMPLE XXX

A photoconductive imaging member having two electrically operative layers is fabricated by using the same procedures and materials as described in Example II, with the exception that the ALGOFLON is replaced by ACUMIST (available from Allied-Signal, Inc.) for the invention anti-curl layer formulation. POLYMIST is irregular shape micronized waxy polyethylene particles having the molecular formula $CH_3(CH_2)_mCH_2$ where m is a number of repeating units for a molecular weight between about 2000 and about 3500. The oxidized ACUMIST is a polyethylene homopolymer having a molecular formula $CH_3(CH_2)_mCH_2COOH$. For better anti-curl layer preparation, the ACUMIST is classified to provide a particle size distribution ranging from about 0.1 micrometers to about 4.5 micrometers, the average particle size of which is about 2.5 micrometers in diameter. The resulting invention anti-curl layer of the fabricated photoreceptor device has a 14 micrometers dry thickness and contains 2 weight percent ACUMIST.

EXAMPLE XXXI

A photoconductive imaging member is fabricated in the same fashion as described in Example XXX, except that the 14 micrometers dry thickness anti-curl layer contains 5 weight percent ACUMIST.

EXAMPLE XXXII

A photoconductive imaging member is fabricated in the same fashion as described in Example XXX, except that the ACUMIST content in the 14 micrometers dry thickness anti-curl layer is 10 weight percent.

EXAMPLE XXXIII

A photoconductive imaging member is fabricated in the same fashion as described in Example XXX, except that the 14 micrometers dry thickness anti-curl layer is filled with 15 weight percent ACUMIST.

EXAMPLE XXXIV

A photoconductive imaging member having two electrically operative layers is fabricated using the same procedures and materials as described in Example II, with the exception that the ALGOFLON is replaced by Polyethylene Wax (available from Petrolite Corporation) for the invention anti-curl layer formulation. Polyethylene Wax is irregular shape particles that have inherent lubrication characteristics. For present invention application purpose, the particles are classified to provide a particle size distribution ranging from about 0.1 micrometer to about 4.5 micrometers, the average particle size of which is about 2.5 micrometers in diameter. The resulting invention anti-curl layer of the fabricated photoreceptor device has a 14 micrometers dry thickness and contains 2 weight percent Polyethylene Wax.

EXAMPLE XXXV

A photoconductive imaging member is fabricated in the same fashion as described in Example XXXIV, except that the 14 micrometers dry thickness anti-curl layer contains 5 weight percent Polyethylene Wax.

EXAMPLE XXXVI

A photoconductive imaging member is fabricated in the same fashion as described in Example XXXIV, except that the 14 micrometers dry thickness anti-curl layer is loaded with 10 weight percent Polyethylene Wax.

EXAMPLE XXXVII

A photoconductive imaging member is fabricated in the same fashion as described in Example XXXIV, except that the Polyethylene Wax content is 15 weight percent.

EXAMPLE XXXVIII

The photoconductive imaging members having the anti-curl layers of the present invention are evaluated for 180° peel strength and coefficient of surface contact friction against a charge transport layer surface and against itself.

The 180° peel strength is determined by cutting a minimum of five 0.5 inch x 6 inches imaging member samples from each of Examples I through XXXVII. For each sample, the anti-curl layer is partially stripped from the supporting PET substrate with the aid of a razor blade and then hand peeled to about 3.5 inches from one end to expose part of the underlying PET substrate. The test imaging member sample is secured with its charge transport layer surface toward a 1 inch x 6 inches x 0.5 inch aluminum backing plate with the aid of two sided adhesive tape. The end of the resulting assembly opposite to the end from which the anti-curl layer was not stripped is inserted into the upper jaw of an Instron Tensile Tester. The free end of the partially peeled anti-curl layer is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer by the width of the test sample.

The coefficient of surface contact friction against the charge transport layer of Example I for each anti-curl layer of Examples I through XXXVII is evaluated. The coefficient of friction test is carried out by first anchoring a test imaging member sample (with the anti-curl layer face up) to a platform surface. The test imaging sample of Example I is then secured to the bottom surface of a horizontally sliding plate weighing 200 grams. The sliding plate, having the test imaging member sample with its charge transport layer facing downward, is dragged in a straight line over the platform against the anti-curl layer. The sliding plate is connected to one end of a thin cable threaded around a low friction pulley and attached to an Instron jaw, and is dragged when the cable is pulled by the Instron Tester. The coefficient of friction for the anti-curl layer against itself is conducted by repeating the procedures again, except that the attachment of the test imaging member sample of Example I to the bottom surface of the sliding plate is replaced by a sister test imaging member sample having the same anti-curl layer as that anchoring over the platform. The coefficient of surface contact friction for each test described above is calculated by dividing the load obtained by 200 grams.

The results obtained are presented in Table I below. They show that the use of any of these organic fillers incorporated in an anti-curl layer of the present invention enhances the anti-curl layer's adhesion strength to the PET supporting substrate, and also produces marked improvement in its frictional property.

TABLE I

| EXAMPLE | 180° Peel Strength (gm/cm) | Static Coefficient of Friction Against Transport Layer | Static Coefficient of Friction Against Itself |
|---|---|---|---|
| I Control | 21 | 2.98 | 3.10 |
| II | 30 | 0.97 | 0.76 |
| III | 48 | 0.81 | 0.72 |
| IV | 63 | 0.76 | 0.67 |
| V | 81 | 0.74 | 0.65 |
| VI | 35 | 0.95 | 0.71 |
| VII | 50 | 0.77 | 0.65 |
| VIII | 65 | 0.75 | 0.61 |
| IX | 83 | 0.73 | 0.60 |
| X | 40 | 0.98 | 0.79 |
| XI | 70 | 0.87 | 0.75 |
| XII | 117 | 0.80 | 0.71 |
| XIII | 136 | 0.75 | 0.70 |
| XIV | 44 | 1.00 | 0.80 |
| XV | 68 | 0.88 | 0.74 |
| XVI | 120 | 0.82 | 0.71 |
| XVII | 135 | 0.81 | 0.70 |
| XVIII | 30 | 0.98 | 0.79 |
| XIX | 52 | 0.87 | 0.77 |
| XX | 105 | 0.84 | 0.73 |
| XXI | 119 | 0.81 | 0.72 |
| XXII | 61 | 0.99 | 0.78 |
| XXIII | 84 | 0.90 | 0.75 |
| XXIV | 110 | 0.85 | 0.73 |
| XXV | 138 | 0.79 | 0.71 |
| XXVI | 52 | 0.98 | 0.81 |
| XXVII | 82 | 0.91 | 0.76 |
| XXVIII | 112 | 0.84 | 0.74 |
| XXIX | 136 | 0.79 | 0.71 |
| XXX | 72 | 0.97 | 0.78 |
| XXXI | 113 | 0.86 | 0.75 |
| XXXII | 128 | 0.80 | 0.71 |
| XXXIII | 139 | 0.75 | 0.68 |
| XXXIV | 70 | 0.98 | 0.79 |
| XXXV | 108 | 0.90 | 0.75 |
| XXXVI | 120 | 0.83 | 0.72 |
| XXXVII | 128 | 0.78 | 0.70 |

EXAMPLE XXXIX

The invention anti-curl layers of the photoconductive imaging members of Examples III/IV, VII/VIII, XI,XII, XV/XVI, XIX/XX, XXIII/XXIV, XXVII/XXVIII, XXXI/XXXII, AND XXXV/XXXVI are evaluated, along with the control photoconductive imaging member of the Comparative Example I, for wear resistance, ultra-sonic seam welding and sonic horn wear.

For wear resistance determination, these photoconductive imaging members are cut into test imaging member samples to the size of 1 inch in width by 12 inches in length. Testing is effected by means of a dynamic mechanical cycling device in which glass tubes are skidded across the surface of the anti-curl layer on each test imaging member sample. More specifically, one end of the test sample is clamped to a stationary post and the sample is loaded upward over three equally spaced horizontal glass tubes and then downwardly over a stationary guide tube through a generally inverted "U" shaped path with the free end of sample secured to a weight which provides one pound per inch width tension on the sample. The face of the test imaging member sample bearing the anti-curl layer is facing downward such that it is allowed to contact the glass tubes. The glass tubes have a diameter of one inch. Each tube is secured at each end to an adjacent vertical surface of a pair of disks that are rotatable about a shaft connecting the centers of the disks. The glass tubes are parallel to and equidistant from each other and equidistant from the shaft connecting the centers of the disks. Although the disks are rotated about the shaft, each glass tube is rigidly secured to the disk to prevent rotation of the tubes around each individual tube axis. Thus, as the disk rotates about the shaft, two glass tubes are maintained at all times in sliding contact with the surface of the anti-curl layer. The axis of each glass tube is positioned about 4 cm from the shaft. The direction of movement of the glass tubes along the anti-curl layer surface is away from the weighted end of the sample toward the end clamped to the stationary post. Since there are three glass tubes in the test device, each complete rotation of the disk is equivalent to three wear cycles in which the surface of the anti-curl layer is in sliding contact with a single stationary support tube during testing. The rotation of the spinning disk is adjusted to provide the equivalent of 11.3 inches per second tangential speed. The extent of the anti-curl layer wear is measured using a permascope after 165,000 wear cycles and at the end of a 330,000 wear cycles testing. The wear results listed in the following Table II indicate that the wear resistance of the anti-curl layer filled with any of the invention organic particles is improved by about three times at 5 weight percent loading. The wear resistance of the anti-curl layer is further enhanced to a little over six times when the level of filler incorporation is increased to 10 weight percent. The anti-curl layer wear life extension by organic filler reinforcement has been demonstrated. The observed wear and frictional property improvement of the present invention anti-curl layers is contributed by the intrinsic lubricating characteristics of these filler additives.

TABLE II

| | Amount of Anti-Curl Layer Wear | |
|---|---|---|
| EXAMPLE | After 165,000 wear cycles (micrometers) | After 330,000 wear cycles (micrometers) |
| I (Control) | 6.3 | 12.0 |
| III/IV | 1.9/0.9 | 3.9/1.7 |
| VII/VIII | 1.7/0.8 | 3.4/1.5 |
| XI/XII | 2.4/1.2 | 4.4/2.1 |
| XV/XVI | 2.1/1.2 | 4.0/2.1 |
| XIX/XX | 2.3/1.3 | 3.9/2.0 |
| XXIII/XXIV | 2.1/1.1 | 4.1/2.3 |
| XXVII/XXVIII | 2.0/1.2 | 3.9/2.2 |
| XXXI/XXXII | 1.9/0.9 | 3.8/1.8 |
| XXXV/XXXVI | 2.1/1.2 | 4.0/2.1 |

When ultrasonically welded into a lap-joined seam, these photoconductive imaging members give values of ultimate tensile seam strength about equal to that obtained for the control seam counterpart, fabricated using the photoconductive imaging member of Comparative Example I.

Unlike the notable sonic horn wear in the case of micro-crystalline silica incorporation in the anti-curl layer, the present invention of organic filler addition to the anti-curl layers produces no discernible horn wear after completion of the ultra-sonic seam welding processes for the photoconductive imaging members mentioned above.

EXAMPLE XXXX

For optical transmission evaluation, the invention anti-curl layer solutions having organic particulate dispersion are prepared according to the procedures and using the same materials as described in Examples II through XXXVII. The anti-curl layer solution of Comparative Example I having no filler dispersion, is also prepared to serve as a control. These anti-curl layer solutions are cast over Teflon coated release papers, by hand coating using a 5 mil gap Bird applicator, to yield 14 micrometers dry thickness anti-curl layer films after drying at 135° C. for 5 minutes in a forced air oven.

These free standing anti-curl films are evaluated for total optical transmission in the visible wavelength range between 400 and 700 nanometers, using a Spectrophotometer equipped with an integration sphere. The values of total optical transmittancy measured for the 2, 5 and 10 weight percent filler loaded films are found to be about equivalent to that of the control film. However, the total optical transmitting fall-off is evident at 15 weight percent level of filler loading. The loss of light energy transmitting through the film is calculated to be about 10 percent.

Although the invention has been described with reference to specific preferred embodiments, it is not intended to be limited thereto. Rather, those skilled in the art will recognize that variations and modifications may be made therein which are within the spirit of the invention and within the scope of the claims.

What is claimed is:

1. An electrophotographic imaging member comprising an anti-curl layer comprised of a binder, and a dispersion of at least one organic filler selected from the group consisting of fluorocarbon polymers, polyethylene waxes, polypropylene waxes, metal stearates, fatty amides, and polyethylene-fluorocarbon blends, a flexible supporting substrate and a photoconductive layer.

2. The electrophotographic imaging member of claim 1, wherein said binder is polycarbonate.

3. The electrophotographic imaging member of claim 2, wherein said polycarbonate is at least one of poly(4,4'-isopropylidene diphenylene carbonate) and 4,4,-cyclohexylidene diphenyl polycarbonate.

4. The electrophotographic imaging member of claim 1, wherein said anti-curl layer further comprises a copolyester adhesion promoter.

5. The electrophotographic imaging member of claim 4, comprising about 1 percent by weight to about 15 percent by weight of said copolyester adhesion promoter.

6. The electrophotographic imaging member of claim 1, wherein said filler is comprised of particles and is homogeneously dispersed.

7. The electrophotographic imaging member of claim 6, wherein said dispersed particles have a diameter substantially less than a thickness of said anti-curl layer.

8. The electrophotographic imaging member of claim 1, wherein said layer comprises about 0.5 percent by weight to about 20 percent by weight of said filler.

9. The electrophotographic imaging member of claim 6, wherein said particles have a diameter of about 0.1 micrometer to about 4.5 micrometers and an average diameter of about 2.5 micrometers.

10. The electrophotographic imaging member of claim 1, wherein said filler is selected from the group consisting of polytetrafluoroethylene, gamma ray irradiated polytetrafluoroethylene, waxy polyethylene, waxy polypropylene, and polyethylene/polytetrafluoroethylene blends.

11. The electrophotographic imaging member of claim 1, wherein said metal stearates are selected from the group consisting of zinc stearates, tin stearates, stannous stearates, calcium stearates and magnesium stearates.

12. The electrophotographic imaging member of claim 1, wherein said fatty amides are selected from the group consisting of oleamide, erucamide, stearamide and N,N'-ethylene bisstearamide.

13. An electrophotographic imaging member comprising an anti-curl layer, a flexible supporting substrate having an electrically conductive layer, a hole blocking layer, an adhesive layer, a charge-generating layer, and a charge transport layer, said anti-curl layer comprising a binder and a dispersion of organic filler selected from the group consisting of fluorocarbon polymers, polyethylene waxes, polypropylene waxes, metal stearates, fatty amides, and polyethylene-fluorocarbon blends.

14. The electrophotographic imaging member of claim 13, wherein said filler is comprised of particles and is homogeneously dispersed.

15. The electrophotographic imaging member of claim 14, wherein said particles have a diameter substantially less than the thickness of said anti-curl layer.

16. The electrophotographic imaging member of claim 14, wherein said particles have a diameter of about 0.1 micrometer to about 4.5 micrometers and an average diameter of about 2.5 micrometers.

17. The electrophotographic imaging member of claim 13, wherein said anti-curl layer comprises about 0.5 percent by weight to about 20 percent by weight of said filler.

18. The electrophotographic imaging member of claim 13, wherein said organic filler is selected from the group consisting of polytetrafluoroethylene, gamma ray irradiated polytetrafluoroethylene, waxy polyethylene, waxy polypropylene, and polyethylene/polytetrafluoroethylene blends.

19. The electrophotographic imaging member of claim 13, wherein said metal stearates are selected from the group consisting of zinc stearates, tin stearates, stannous stearates, calcium stearates, and magnesium stearates.

20. The electrophotographic imaging member of claim 13, wherein said fatty amides are selected from the group consisting of oleamide, erucamide, stearamide, and N,N'-ethylene bisstearamide.

* * * * *